US010727629B1

(12) United States Patent
Altamura

(10) Patent No.: US 10,727,629 B1
(45) Date of Patent: Jul. 28, 2020

(54) CENTRAL SHAFT POWER CONNECTOR FOR LIGHTED ORNAMENTS

(71) Applicant: Seasonal Specialties, LLC, Eden Prairie, MN (US)

(72) Inventor: Steven J. Altamura, Scarsdale, NY (US)

(73) Assignee: Seasonal Specialties, LLC, Eden Prairie, MN (US)

( * ) Notice: Subject to any disclaimer, the term of this patent is extended or adjusted under 35 U.S.C. 154(b) by 0 days.

(21) Appl. No.: 16/655,305

(22) Filed: Oct. 17, 2019

Related U.S. Application Data

(60) Continuation of application No. 16/280,912, filed on Feb. 20, 2019, now Pat. No. 10,454,211, which is a division of application No. 15/968,064, filed on May 1, 2018, now Pat. No. 10,333,252.

(60) Provisional application No. 62/500,054, filed on May 2, 2017.

(51) Int. Cl.

| | |
|---|---|
| ***H01R 13/631*** | (2006.01) |
| ***H01R 43/26*** | (2006.01) |
| ***H01R 13/639*** | (2006.01) |
| ***H01R 24/20*** | (2011.01) |
| *A47G 33/06* | (2006.01) |
| *F21W 121/04* | (2006.01) |
| *F21W 131/30* | (2006.01) |
| *A47G 33/08* | (2006.01) |
| *H01R 13/645* | (2006.01) |
| *H01R 13/642* | (2006.01) |
| *H01R 13/64* | (2006.01) |
| *H01R 13/641* | (2006.01) |

(52) U.S. Cl.
CPC ..... *H01R 13/631* (2013.01); *H01R 13/639* (2013.01); *H01R 24/20* (2013.01); *H01R 43/26* (2013.01); *A47G 33/06* (2013.01); *A47G 2033/0827* (2013.01); *F21W 2121/04* (2013.01); *F21W 2131/30* (2013.01); *H01R 13/64* (2013.01); *H01R 13/641* (2013.01); *H01R 13/642* (2013.01); *H01R 13/6456* (2013.01)

(58) Field of Classification Search
CPC .. H01R 13/64; H01R 13/6456; H01R 13/642; H01R 13/639; H01R 13/641
USPC ..... 439/680
See application file for complete search history.

(56) References Cited

U.S. PATENT DOCUMENTS

| | | | | |
|---|---|---|---|---|
| 4,275,374 A | | 6/1981 | Chaucer | |
| 5,281,158 A | | 1/1994 | Lin | |
| 5,776,559 A | * | 7/1998 | Woolford | F21S 4/10 362/123 |

(Continued)

FOREIGN PATENT DOCUMENTS

| | | |
|---|---|---|
| WO | 2013091920 | 6/2013 |

*Primary Examiner* — Abdullah A Riyami
*Assistant Examiner* — Justin M Kratt
(74) *Attorney, Agent, or Firm* — Hamre, Schumann, Mueller & Larson, P.C.

(57) ABSTRACT

A central shaft power connector for lighted ornaments is disclosed. A central support pole, such as for a Christmas tree is made in two parts joinable with an electrical and mechanical connector which joins the pole parts and simultaneously connects power or other circuits from one part to the other. The connector has two engaging sections and an outrigger platform which locates a connector off to the side of the poles but in alignment. Final alignment is obtained by a key and keyway in the connector parts.

7 Claims, 10 Drawing Sheets

(56) References Cited

U.S. PATENT DOCUMENTS

| | | | | |
|---|---|---|---|---|
| 6,883,951 | B2 * | 4/2005 | Wu | A47G 33/06 362/123 |
| 6,951,405 | B2 | 10/2005 | Yao | |
| 7,052,156 | B2 * | 5/2006 | Primeau | A47G 33/06 362/123 |
| 8,053,042 | B1 * | 11/2011 | Loomis | A47G 33/06 362/123 |
| 8,936,379 | B1 | 1/2015 | Chen | |
| 9,044,056 | B2 | 6/2015 | Chen | |
| 9,209,546 | B1 * | 12/2015 | Gibboney, Jr. | H01R 13/17 |
| 9,222,656 | B2 | 12/2015 | Chen | |
| 9,439,528 | B2 | 9/2016 | Chen | |
| 9,577,376 | B1 | 2/2017 | Tsai | |
| 9,620,896 | B1 * | 4/2017 | Dubbaka | H01R 13/631 |
| 9,671,074 | B2 | 6/2017 | Chen | |
| 9,700,169 | B2 | 7/2017 | Wong | |
| 9,883,566 | B1 | 1/2018 | Chen | |
| 9,883,706 | B2 | 2/2018 | Chen | |
| 9,894,949 | B1 | 2/2018 | Chen | |
| 9,979,126 | B2 | 5/2018 | Takamura | |
| 10,305,237 | B1 | 5/2019 | Li | |
| 10,333,252 | B1 | 6/2019 | Altamura | |
| 10,454,211 | B1 | 10/2019 | Altamura | |
| 2007/0230174 | A1 * | 10/2007 | Hicks | A47G 33/06 362/249.16 |
| 2014/0287618 | A1 | 9/2014 | Chen | |
| 2016/0081508 | A1 | 3/2016 | Wong | |

* cited by examiner

CENTRAL SHAFT POWER CONNECTOR FOR LIGHTED ORNAMENTS

BACKGROUND OF THE DISCLOSURE

Field of the Disclosure

The present disclosure is directed to a power connector adjunct to a structural pole whose most common use is in connection with tall standing ornamental lighting whose pole is separable to reduce height for shipping, such as a lighted Christmas tree.

Description of the Related Art

Ornamental lighting on poles, such as pre-lit Christmas trees are often too tall to be shipped in a box. In order to reduce their height, it is necessary for their central structural pole to be divided into multiple sections which are later joined. In pre-lit trees (i.e. trees which have their light strings affixed at the factory), there has to be a way to connect the various light strings after assembly. In the prior art, this was most often accomplished by simple power plugs hanging from branches of the tree. The user had to dig into the tree, which was often very dense, and manually make connections.

A solution which allows the user to automatically connect sections of the tree power both physically and electrically is needed.

A method of manufacture is also disclosed.

The present disclosure in various embodiments overcomes these problems.

BRIEF SUMMARY

The disclosure encompasses many embodiments. One such embodiment is detailed below in summary fashion. Please understand that this summary does not encompass the entire disclosure but is provided to assist the reader in reviewing the entire disclosure and claims which also constitute part of the disclosure.

There is disclosed a central pole/staff which is composed of at least two parts, one of which is received partially within the other to create a contiguous pole along a central axis. The pole may be made of two segments, a first and second segment, each segment being connected to a two part joint having first and second portions respectively.

The two portions fit into each other and fit into the pole segments. The portions form an intermediary joint between pole segments.

The first portion has a central aperture on its lower end and a tubular projection (which may be noncircular) on the upper end sized to be received within the first pole segment. The second portion has an upper central projection sized to be received within the first portion aperture. The second portion also has a lower aperture sized to receive the second pole segment therein.

The first portion includes a first ledge extending generally orthogonally away from the segments and the axis. The first ledge includes a first connector part extending therefrom.

The second portion includes a second ledge extending generally orthogonally away from the segments and the axis. The second ledge includes a second connector part extending therefrom. Said first and second connector parts aligned to electrically engage when said first and second portions are engaged.

In some embodiments, the first connector part includes a first block having a plurality of terminals, and the second connector part includes a recess and terminals for receiving and electrically connecting to said block.

In some embodiments the aperture on said first portion includes a guide keyway slot and the projection on said second portion includes a keyway pin, so that the slot and pin maintain alignment of the block and recess.

In some embodiments, the aperture on the first portion includes a tapered section and wherein the projection on said second portion includes an expanded diameter section at its proximal end, said expanded diameter section and said tapered section being sized to mate with each other.

Note that the terms upper and lower are only relative and may be reversed and are not necessarily according to the force of gravity.

Many other features and combinations are disclosed and claimed.

DETAILED DESCRIPTION

Figure 1:
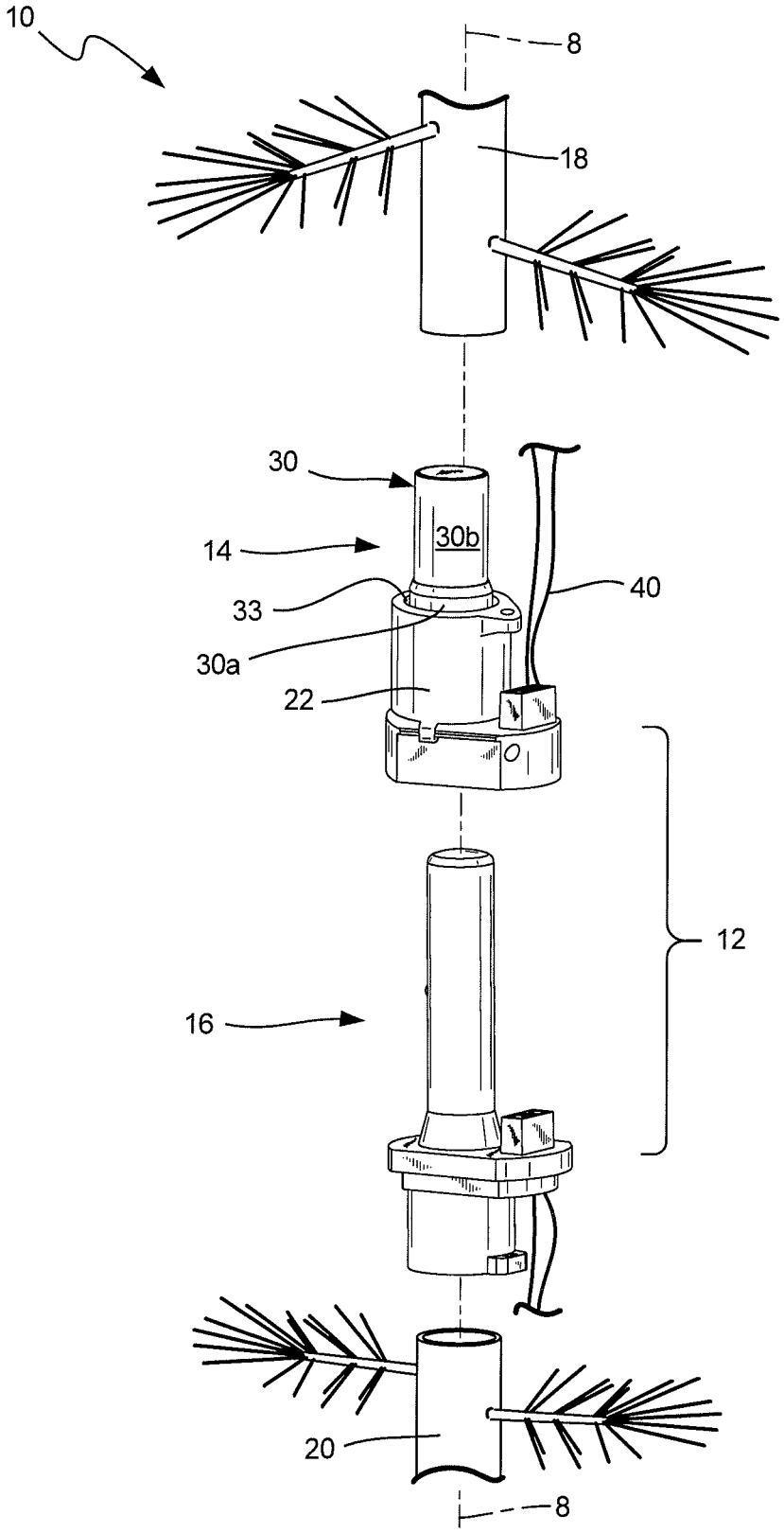
FIG. 1 is a perspective view of a Central Shaft Power Connector for Lighted Ornaments.
Figure 2:
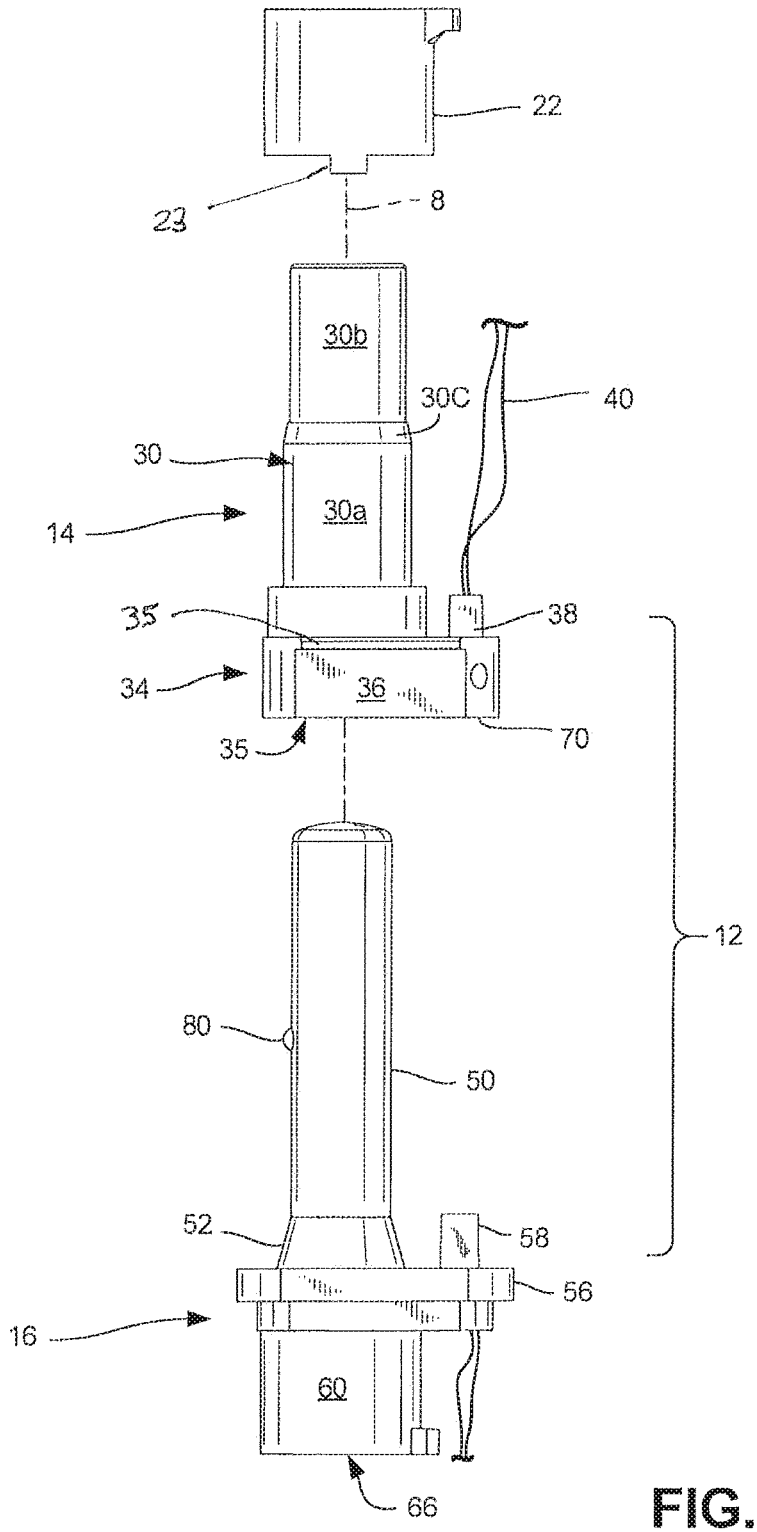
FIG. 2 is an exploded side view of FIG. 1.
Figure 3:
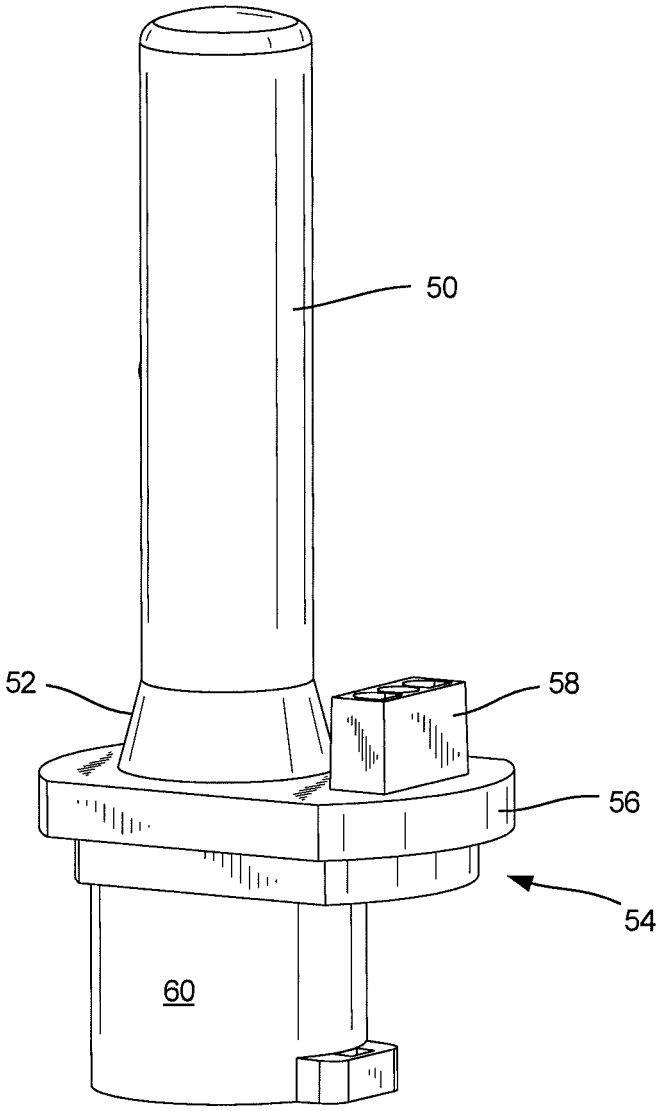
FIG. 3 is a side perspective view of the lower/second part of the connector.
Figure 4:
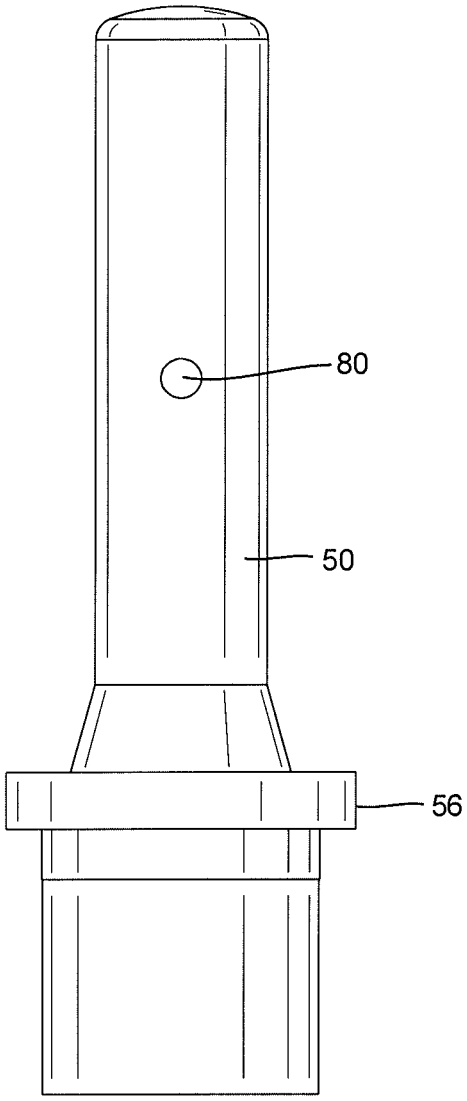
FIG. 4 is a view like FIG. 3 except the rear plan.
Figure 5:
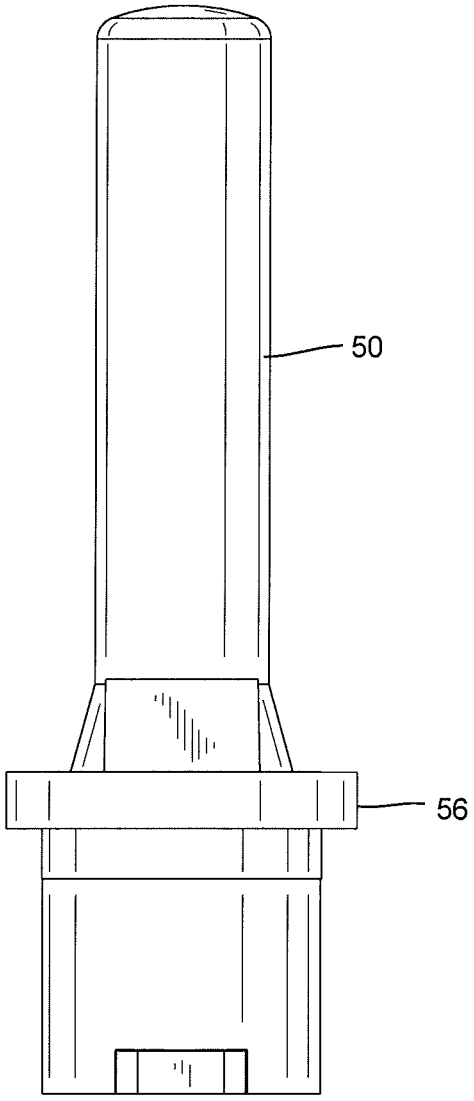
FIG. 5 is a view like FIG. 3 except the front plan.
Figure 6:
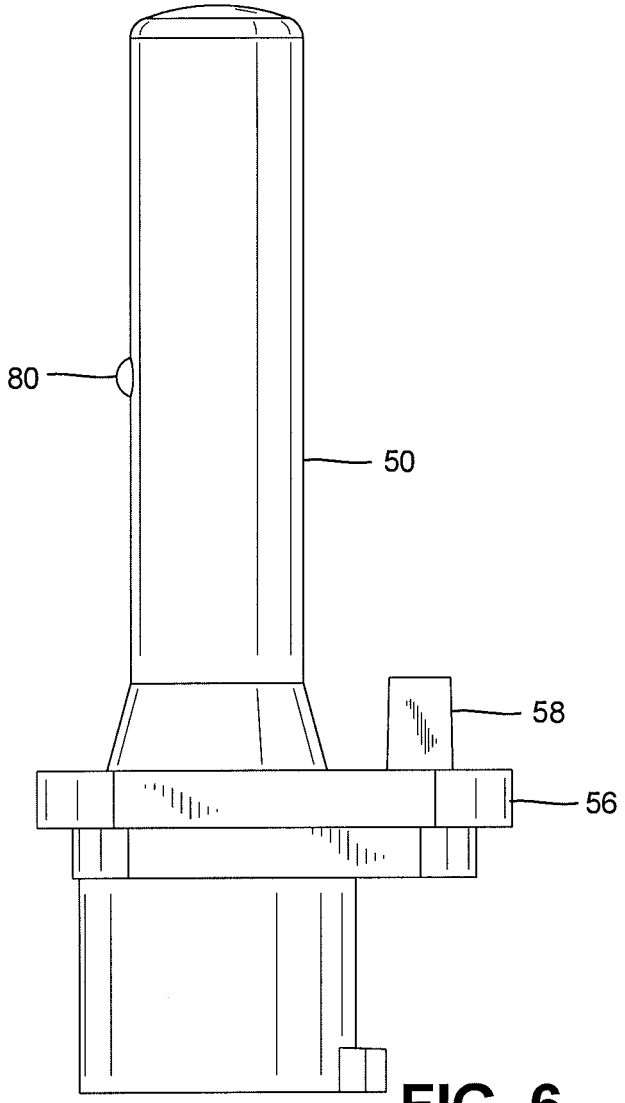
FIG. 6 is a view like FIG. 4 except the side plan.

FIGS. 1 and 2 illustrate a preferred installation on a Christmas tree pole or other ornamental lighting fixture which requires power being supplied from one portion of the structural pole to the other.

Here is a description of subcomponents: 8 is a central axis along which several parts are aligned; 10 the system of pole and connector; 12 the connector; 14 the upper/first portion of the connector; 16 the lower/second portion of the connector; 18 the upper/first central pole segment with branches showing; 20 the lower/second central pole segment with branches showing; 22 (FIG. 2) collar/sleeve. The retainer collar 22 includes a pair of opposing hooks 23 (only one shown) which have a lip which engages ridge 35 on ledge 36. The collar is used to clamp a further part of the pole to this connector. Element 30 is the upper portion protrusion/projection having two diameters 30*a*/30*b* and tapered section 30*c* therebetween. The projection is sized to be received within pole portion. Collar 22 fits and snaps over section 30*a* and creates a gap between the two diameters which provides a strong connection with the pole segment.

Figure 7:
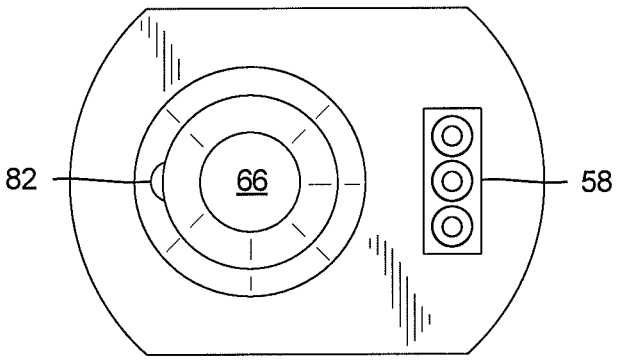
FIG. 7 is a bottom plan view.
Figure 8:
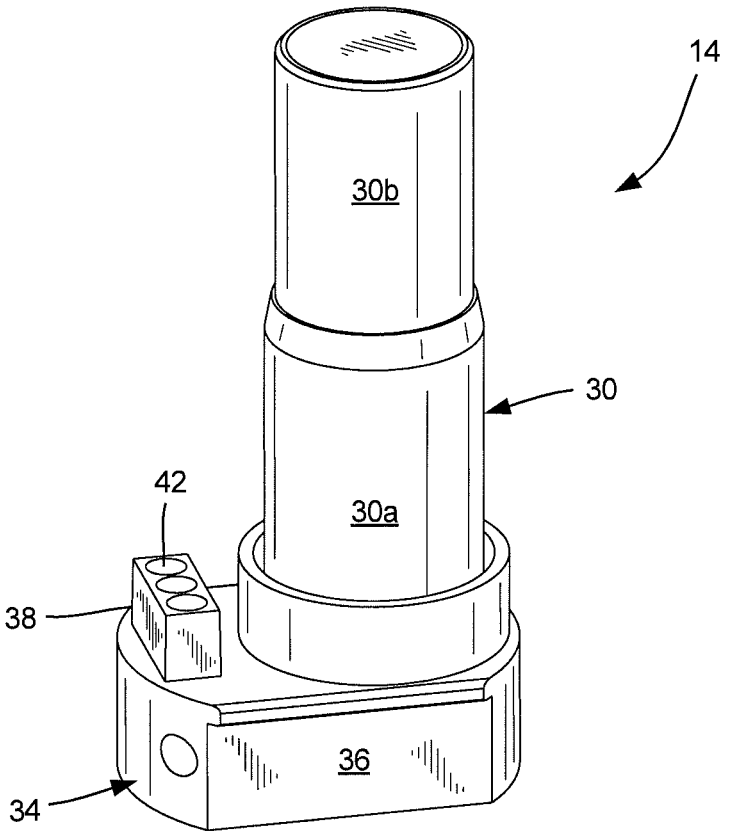
FIG. 8 is a perspective view of the upper/first portion of the connector.
Figure 9:
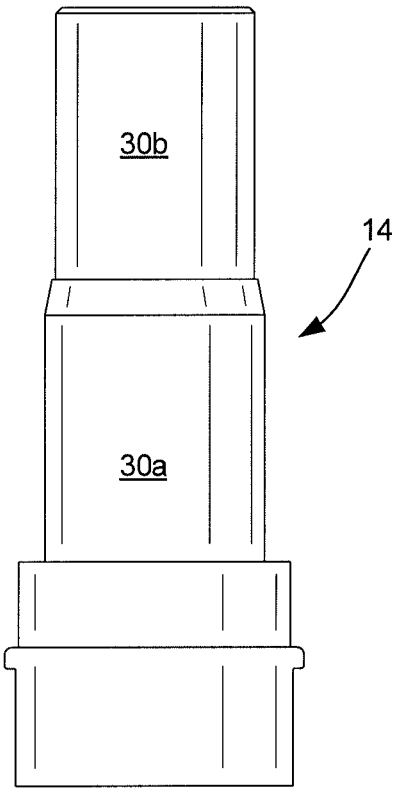
FIG. 9 is a rear plan view of FIG. 8.
Figure 10:
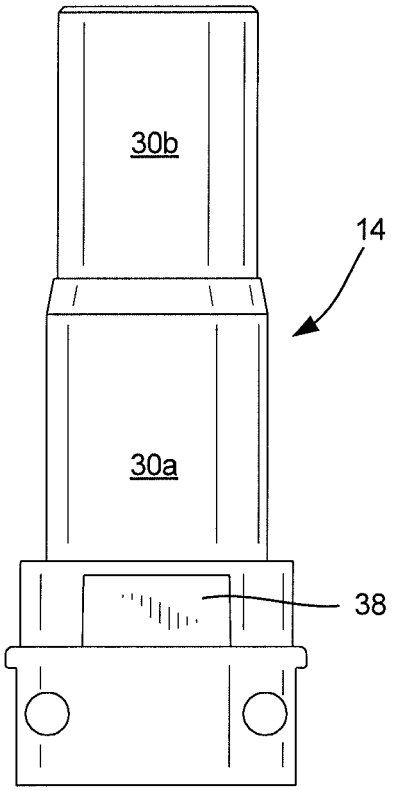
FIG. 10 is a front plan view of FIG. 9.
Figure 11:
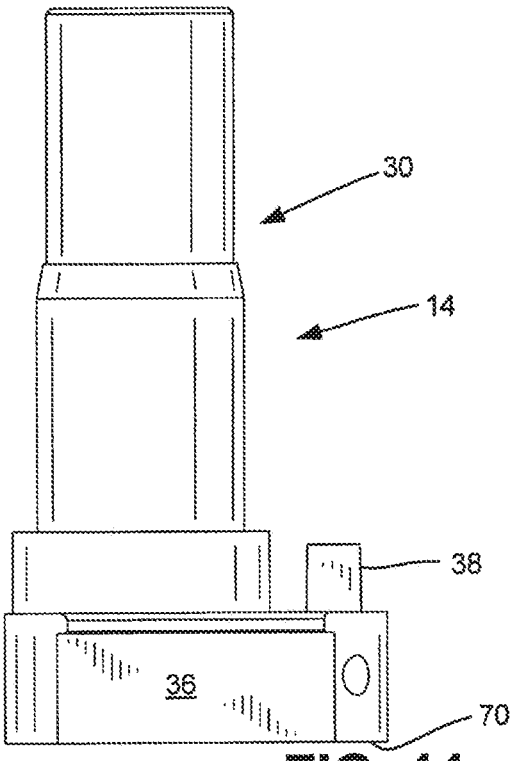
FIG. 11 is a side plan view of FIG. 10
Figure 12:
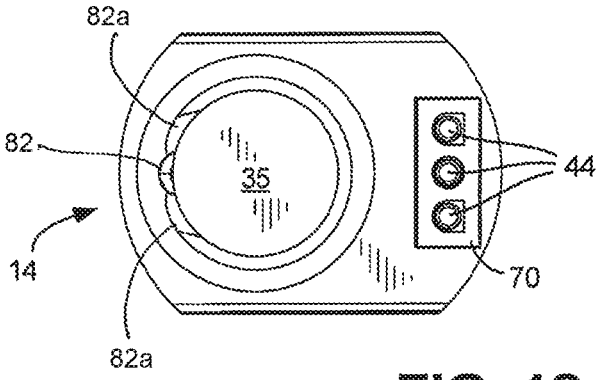
FIG. 12 is a top plan view of FIG. 11.
Figure 13:
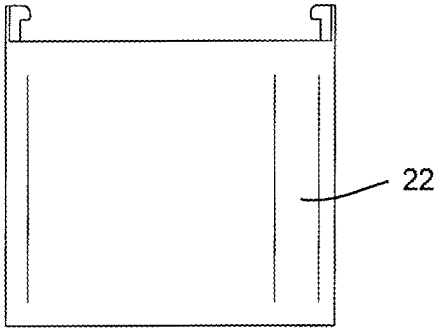
FIG. 13 is a side view of a removable collar/sleeve in FIG. 2.
Figure 14:
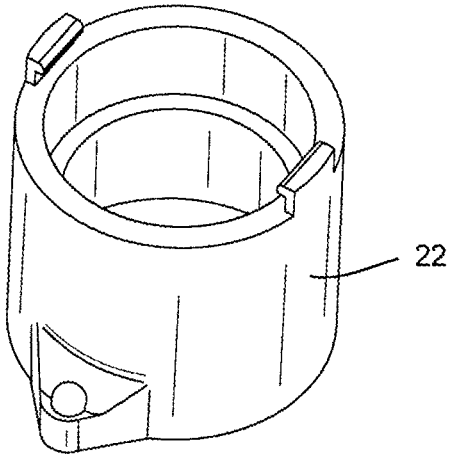
FIG. 14 is a perspective view of the collar.
Figure 15:
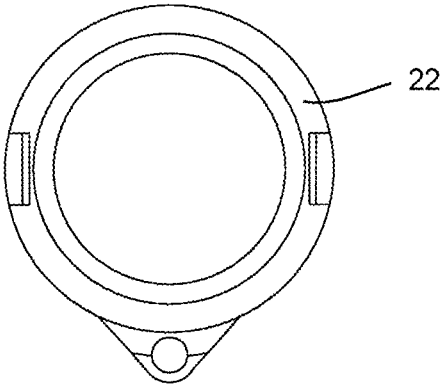
FIG. 15 is a top view of the collar.
Figure 16:
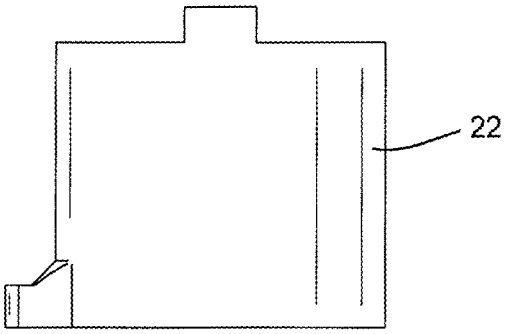
FIG. 16 is a view like FIG. 13 rotated 90 degrees.

The following is a description of elements shown in the figures: 33 is the gap between the collar 22 and the projection 30*a* (the taper in projection 30*a* may be taller than shown in FIG. 1 to provide more stability), the gap is sized to receive pole segment 18; 34 is the base of the upper portion 14; 35 is an aperture (FIGS. 2 and 12) in portion 14 and sized to receive projection/key 80; 36 is a radial and orthogonally extending ledge which is offset from the central axis 8; 38 is a connector projection with wires 40 to be connected to a power plug, not shown; 42 (FIG. 8) are apertures for receiving electrical contacts 44 (FIGS. 8 and 12); 50 is a projection extending from lower section 16. It has a tapered or flared section 52 at its proximal end to frictional engage diameter 30*a*; 54 is a base of the lower portion 16; 56 is a radial and orthogonally extending ledge; 58 is a connector projection sized to mate and engage with projection 38; 60 is a collar extending from based 56, coaxially aligned with projection 50 and defining a recess 66 (FIG. 7); 70 is a recess area (FIG. 12) in upper part 14 which is sized to receive connector 58 from the lower part; 80 is a key projection in projection 50 of lower part 16. 82 is a keyway slot in aperture 66 (FIG. 7) which receives key 80 to insure the alignment of connectors 38 and 58 when upper and lower parts are brought together. Keyway 82 also shown is FIG. 12, preferably includes angled portions 82*a* on either side of the keyway and a concentric section 83 which is sized to receive projection 50. The concentric section is interrupted by the keyway 82 and has a curved edge instead of a sharp corner at the keyway slot. This curved edge assists in urging a misaligned projection 80 into the slot by urging it to align into the center of the slot.

There is disclosed a central pole/staff which is composed of at least two parts 18, 20, one of which is received partially within the other to create, via a connector 12, a contiguous pole along a central axis 8. The pole may be made of two segments, a first 18 and second 20 segment, each segment being connected to a two part joint/connector 12 having first/upper 14 and second/lower 16 portions respectively.

The two portions fit into each other and fit into the pole segments. The portions form an intermediary joint between pole segments.

The first portion has a central aperture 35 on its lower end and a tubular projection 30 (which may be circular, noncircular, or keyed) on the upper end sized to be received within the first pole segment. The second portion 16 has an upper central projection 50 sized to be received within the first portion aperture 35. The second portion also has a lower aperture sized to receive the second pole segment therein.

The first portion 14 includes a first ledge 36 extending generally orthogonally away from the segments and the axis 8. The first ledge includes a first connector part 38 extending orthogonally therefrom.

The second portion 16 includes a second ledge 56 extending generally orthogonally away from the segments and the axis 8. The second ledge includes a second connector part 58 extending therefrom. Said first and second connector parts 38/58 aligned to electrically engage when said first and second portions are engaged. In an alternate embodiment, the electrical connectors are omitted and a separate power line is provided.

In some embodiments, the first connector part includes a first block 38, having a plurality of terminals 42 and the second connector part 58 includes a recess 70, 44 and terminals for receiving and electrically connecting to said block.

Figure 17:
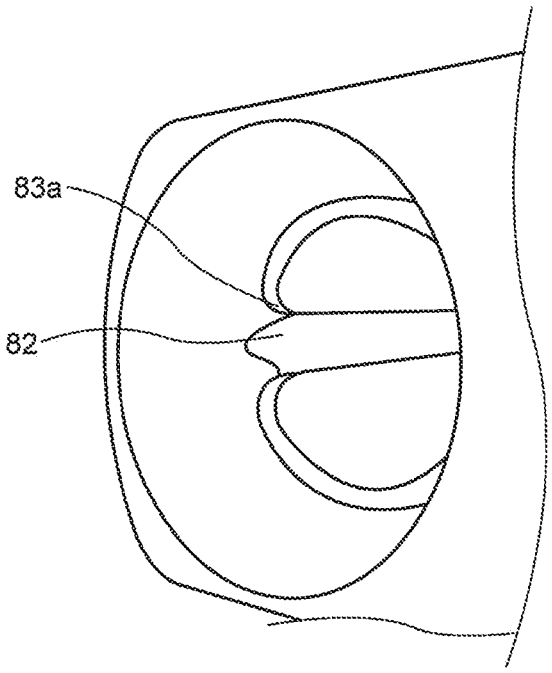
FIG. 17 is a perspective view of a portion of FIG. 12.

In some embodiments the aperture 66 on said first portion includes a guide keyway slot 82 and the projection 80 on said second portion includes a key pin, so that the slot and pin maintain alignment of the connecting blocks when brought together. This is an aligner which maintains the portion in rotational alignment (i.e. to prevent rotation and to minimize the torque on the electrical connectors) when said portions are brought together so that said connectors align and engage. As mentioned, the upper portion of the keyway 82 may have a funnel shaped curved leading edges on either side of the sloped opening to create a trough shaped opening 83*a* which allows the projection 80 to be urged along the funnel shaped curved slanted sidewalls on both sides of the slot opening 80 at the open end of the projection 30. See FIG. 17. The slot 82 which has a width sufficient to allow the entry of projection 80 also includes a front end opening with a pair of curved guide edges 82*a* which have an upper opening wider than the slot and converge to a width equal to the slot width. These edges 82 follow two curves simultaneously a) a downward curved slope to mate with the slot and b) a circular curve which mates with the inner curvature of aperture 35.

In some embodiments, the aperture on the first portion includes a tapered section 30*c* and wherein the projection on said second portion includes an expanded diameter 52 section at its proximal end, said expanded diameter section and said tapered section being sized to mate with each other.

The description of the invention and its applications as set forth herein is illustrative and is not intended to limit the scope of the invention. Variations and modifications of the embodiments disclosed herein are possible and practical alternatives to and equivalents of the various elements of the embodiments would be understood to those of ordinary skill in the art upon study of this patent document. These and other variations and modifications of the embodiments disclosed herein may be made without departing from the scope and spirit of the invention.

The invention claimed is:

1. A central pole connector having a central axis, for mechanically joining an ornamental lighting pole of at least first and second at least partially hollow segments, to create a contiguous pole along the central axis, said central pole connector comprising:

a first connector section, attachable to one of the first and second partially hollow segments, having a first extension at a first end of the first connector section to be received within said one of the first and second partially hollow segments and having an at least partially hollow aperture in a second end of the first connector section, said partially hollow aperture including a discontinuous inner periphery having a keyway slot, at least a portion of said keyway slot being generally coaxially and linearly aligned with said central axis;

a second connector section, being attachable to the other of the first and second partially hollow segments, having a first portion end sized to be received within said first partially hollow segment of said other light pole segment the other of the first and second partially hollow segments and a second portion end having a second extension sized to be received within said partially hollow aperture of said second end of said first connector section which includes said keyway slot;

said second extension including a projecting alignment key extending outwardly from the outer surface of said second extension and sized to be received within said keyway slot of said first connector section, at least a portion of said key being generally coaxially aligned with said central axis;

so that when the first and second connector sections are engaged, the alignment key engagement with the keyway slot insures a fixed rotational orientation between said first and second connector sections.

2. A method of joining two pole sections in axial alignment along a central axis, the pole sections being at least partially hollow segments, to create a contiguous pole along the central axis, comprising the steps of:

forming a first connector section attachable to one of said light pole sections and having a first extension at a first end of the first connector section sized to be received within said one of the first and second partially hollow segments at a first end and having an at least partially hollow aperture in its second end, said second end aperture including a discontinuous inner periphery having a keyway slot, at least a portion of said keyway slot being generally coaxially and linearly aligned with said central axis;

forming a second connector section, attachable to the other of the first and second partially hollow segments, and having a first end sized to be received the other of the first and second partially hollow segments and a second end having a second extension sized to be received within said partially hollow aperture of said second end of said first connector section;

forming a projecting alignment key in said second extension said key extending outwardly from the outer surface of said second extension and sized to be received within said keyway slot of said first connector section;

so that when the first and second connector sections are engaged, the alignment key engagement with the keyway slot insures a fixed rotational orientation between said connector sections.

3. The method of claim 2 wherein guideway front end is formed to include a pair of opposed curved sidewalls one on each opposing side of the slot to urge by rotation configured to guide the projection into said keyway slot if misaligned when inserted.

4. The method of claim 2 wherein keyway slot is formed with a wide opening which converges gradually to a narrower opening.

5. The method of claim 2 wherein keyway slot is formed with a wide opening which converges gradually to a narrower opening along a curved path.

6. The method of claim 2 wherein keyway slot has sidewalls which project from the inner periphery.

7. A central pole connector having a central axis, for mechanically joining a pole of at least first and second segments, to create a contiguous pole along a central axis, comprising:

a connector having first and second portions, each portion having upper and lower ends;

said first portion having a first central aperture on said lower end and a tubular projection at said upper end, said projection being sized to be received within the first pole segment;

said second portion has a central projection at said upper end sized to be received within the first central aperture of the first portion;

said second portion including an aperture at said lower end sized to receive the second pole segment;

said second portion including an alignment key projecting generally orthogonally from said tubular projection;

said first portion including a keyway slot extending along an inner periphery of said central aperture;

said keyway slot having a predetermined width at least large enough to accommodate the alignment key and a front end opening, at least a portion of said keyway slot being generally coaxially and linearly aligned with said central axis.

* * * * *